US007001152B2

(12) United States Patent
Paquet et al.

(10) Patent No.: US 7,001,152 B2
(45) Date of Patent: Feb. 21, 2006

(54) SHROUDED TURBINE BLADES WITH LOCALLY INCREASED CONTACT FACES

(75) Inventors: René Paquet, Montréal (CA); Nicolas Grivas, Dollard des Ormeaux (CA); Richard Brandt, Baie d'Urfe (CA)

(73) Assignee: Pratt & Wiley Canada Corp., Longueuil (CA)

( * ) Notice: Subject to any disclaimer, the term of this patent is extended or adjusted under 35 U.S.C. 154(b) by 0 days.

(21) Appl. No.: 10/681,341

(22) Filed: Oct. 9, 2003

(65) Prior Publication Data

US 2005/0079058 A1 Apr. 14, 2005

(51) Int. Cl.
*F01O 5/22* (2006.01)

(52) U.S. Cl. ..... 416/190; 416/191; 416/192; 29/889.21; 29/889.7

(58) Field of Classification Search ..... 415/173.4, 415/173.5, 173.6, 191, 209.2, 209.3, 209.4, 415/210.1; 416/190–192, 193 A, 195; 29/889.21, 29/889.22, 889.7, 889
See application file for complete search history.

(56) References Cited

U.S. PATENT DOCUMENTS 3,576,377 A 4/1971 Beanland et al.
4,243,360 A 1/1981 Wright
4,710,102 A 12/1987 Ortolano
4,798,519 A 1/1989 Zipps et al.
4,822,248 A 4/1989 Wertz et al.
4,840,539 A 6/1989 Bourcier et al.
5,083,903 A 1/1992 Erdmann
5,120,197 A 6/1992 Brooks et al.
5,154,581 A * 10/1992 Borufka et al. ..... 416/190
5,829,955 A 11/1998 Saito et al.
6,164,916 A 12/2000 Frost et al.
6,241,471 B1 6/2001 Herron
6,371,727 B1 4/2002 Stangeland et al.
6,402,474 B1 6/2002 Okuno
6,491,498 B1 12/2002 Seleski et al.

FOREIGN PATENT DOCUMENTS

FR 1252763 12/1960

* cited by examiner

*Primary Examiner*—Christopher Verdier
(74) *Attorney, Agent, or Firm*—Ogilvy Renault LLP

(57) ABSTRACT

A one-piece blade for a turbine section of a gas turbine engine, the blade comprising a root, an airfoil and a shroud. The shroud extends generally perpendicularly from a tip of the airfoil and is defined by a pair of opposed bearing faces and a pair of opposed non-bearing faces. The bearing faces each have a contact portion adapted to contact a shroud of an adjacent blade. The shroud has a substantially constant nominal thickness and the bearing faces have a substantially constant face thickness across the contact portion, the face thickness being greater than the nominal thickness. The transition between the face thickness and the nominal thickness is substantially discontinuous.

17 Claims, 7 Drawing Sheets

SHROUDED TURBINE BLADES WITH LOCALLY INCREASED CONTACT FACES

TECHNICAL FIELD

The present invention relates generally gas turbine engines, and more particularly to shrouded turbine blades therefor.

BACKGROUND OF THE INVENTION

Numerous problems face the designer of a shrouded gas turbine blade as a result of the high heat and high speed environment in which the shrouded blade must operate. Vibration damping, creep curling, bending stresses, contact stress wear, shroud misalignment and dynamic effects are just a few of the demons facing the designer. And, as if these design problem were not enough, in airborne applications excess weight in itself is also a penalty.

Much attention has been paid in the prior art to improving the damping and bending strength of shrouded blades. However, one area where further improvement is needed is the reduction of contact-related wear between adjacent shrouded blades.

A shrouded rotor blade assembly typically comprises a plurality of airfoil blades extending radially from a rotor having a central axis, and a shroud portion which, as an assembly, forms an annulus around the axis and circumscribing all or a portion of the blades. Throughout this specification and the attached claims, the term "generally perpendicular" is used to refer to the angle of intersection of the annular segmented shroud with the radially-extending blades, and the term "generally planar" is used to refer to the annular planar section (or a segment portion thereof), rotated about the central axis point. Examples of such configuration for shrouded blades are common in the prior art, as shown in U.S. Pat. Nos. 3,576,377, and 4,243,360 for example. In contrast from this typical configuration, FR 1,252,763 in one embodiment, for example proposes a non-annular shroud arrangement which extends acutely (i.e. not generally perpendicularly) from the blades.

Typical prior art shrouded turbine blades generally have a shroud having opposed bearing or contact faces which may be shaped to facilitate interlocking of adjacent shrouds. These shrouds may include different variations in thickness, such as, for example, stiffening rails used to reduce centrifugal deflection, and gradual changes in thickness across the width of the shroud used to reduce bending stresses in the shroud. These features, however, come at the price of increases in shroud weight.

In use, fretting can occur on contract surfaces of abutting turbine shrouds, which is of course undesirable. Prior art such as U.S. Pat. Nos. 3,576,377, 4,822,248 and 6,164,916 teach that the wear resistance of the contact faces may be improved by the introduction of special wear resistant coatings or inserts. While perhaps effective, these solutions introduce manufacturing steps and materials, and therefore cost and reliability issues as well. Further improvement is accordingly needed to improve the contact wear resistance of turbine shrouds.

SUMMARY OF THE INVENTION

It is an object of the present invention to provide a shrouded turbine blade having improved contact wear performance. The invention lowers contact stresses and thereby provides, among other things, a design which is less sensitive to shroud misalignment due to shroud wear, deflection or tolerance stack-up at assembly.

Therefore, in accordance with the present invention, there is provided a one-piece blade for a turbine section of a gas turbine engine, the blade comprising a root, an airfoil and a shroud, wherein the shroud extends generally perpendicularly from a tip of the airfoil and is defined by a pair of opposed bearing faces and a pair of opposed non-bearing faces, the bearing faces each having a contact portion adapted to contact a shroud of an adjacent blade, the shroud having a substantially constant nominal thickness and the bearing faces having a substantially constant face thickness across the contact portion, the face thickness being greater than the nominal thickness, the transition between the face thickness and the nominal thickness being substantially discontinuous.

There is also provided, in accordance with the present invention, a blade for a turbine section of a gas turbine engine, the blade comprising: an airfoil portion extending from a root portion to a tip portion; and a shroud portion extending laterally from the airfoil portion, the shroud portion having a body portion having a substantially constant thickness and a pair of opposed bearing faces each having contact portions adapted to matingly contact a bearing face contact portion of a shroud portion of an adjacent turbine blade, wherein the body portion is generally planar and has an increase in thickness immediately adjacent the contact portion of at least one of the opposed bearing faces to thereby provide substantially all of the contact portion of said bearing face with an increased surface area associated with said increased thickness, and wherein said increased surface area is adapted to lower contact stresses arising from contact with at least one mating bearing face of said adjacent turbine blades.

There is further provided, in accordance with the present invention, a method of reducing face contact stress in a shroud contact face of a shrouded turbine blade, the method comprising the steps of: determining a desired shroud design for a given turbine blade design, the shroud design including a nominal thickness; determining a desired face contact stress for at least one shroud contact face of the shroud, the at least one shroud contact face having a contact portion length; and providing a local increase in the shroud nominal thickness to thereby increase the area of the at least one shroud contact face along said contact portion length, wherein the increase in area corresponds to the desired face contract stress, and wherein the local increase is limited to a region immediately adjacent the at least one shroud contact face.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
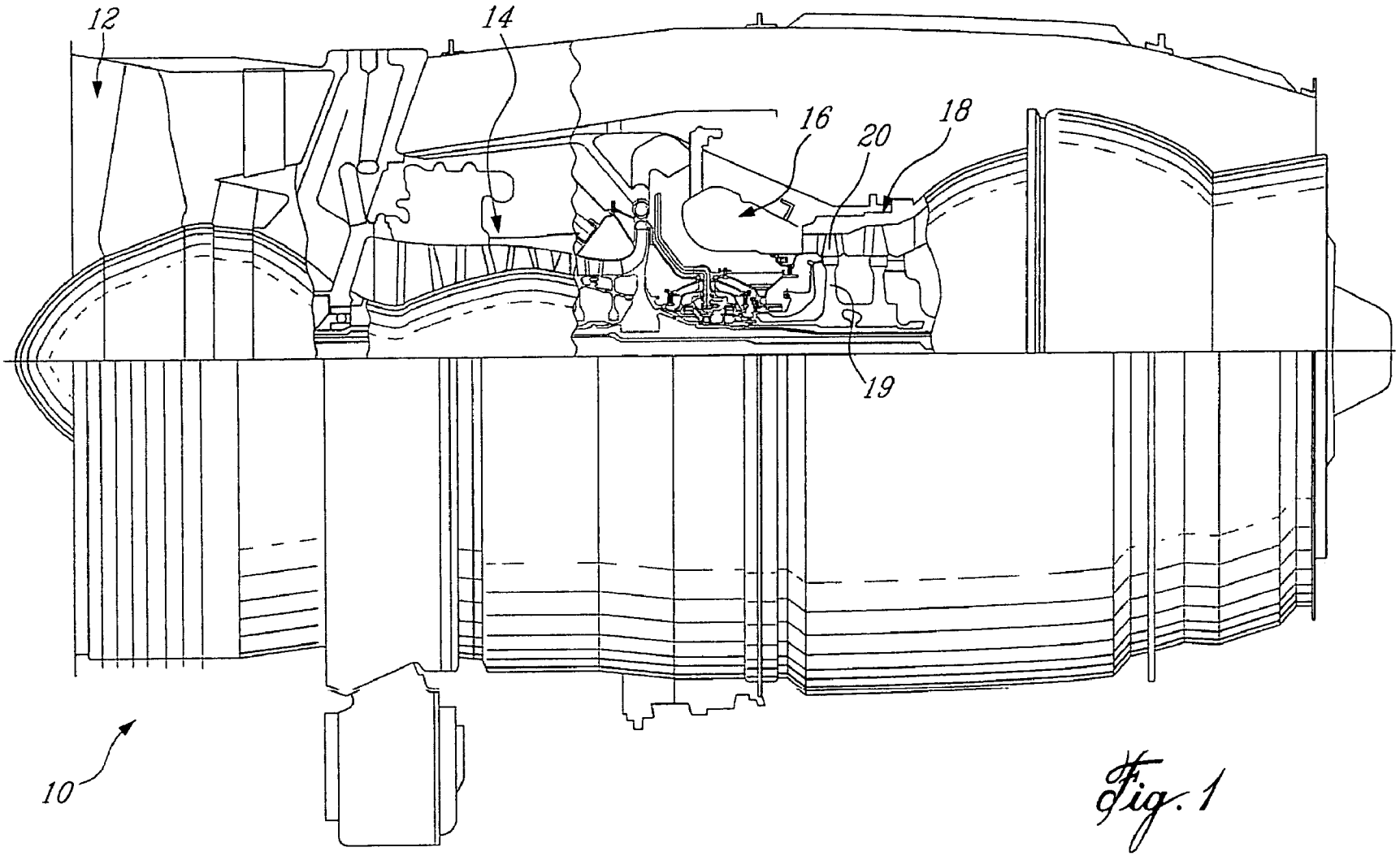
FIG. 1 is a partially-cut away schematic of a gas turbine engine having a turbine blade in accordance with the present invention.

FIG. 1 schematically illustrates a gas turbine engine 10 (a turbofan in this case, though the invention may be practised in almost any gas turbine engine) generally comprising, in serial flow communication, a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The turbine section comprises at least one turbine rotor 19, having a plurality of radially extending turbine blades 20 in accordance with the present invention.

Figure 2:
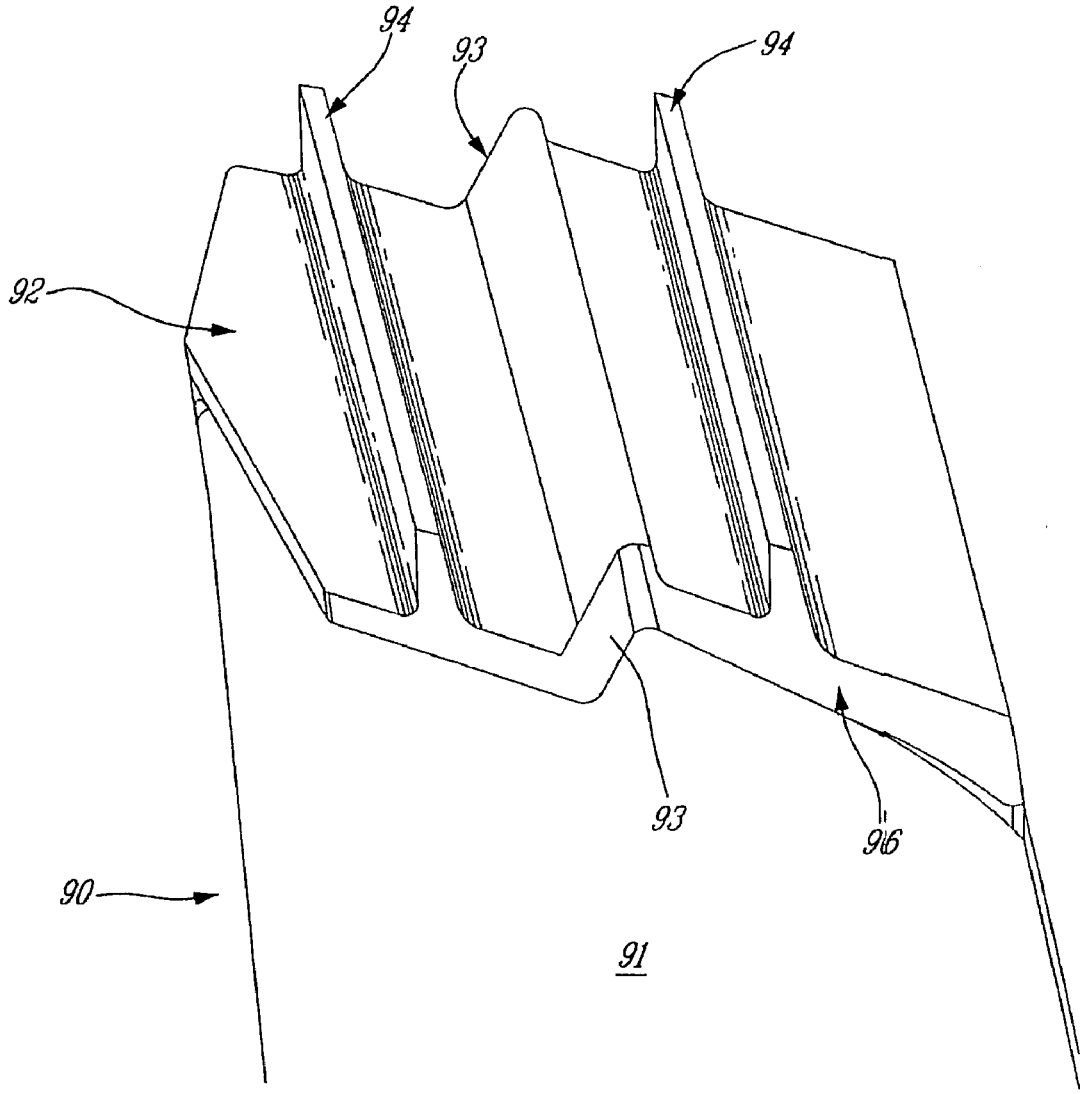
Fig. 2 (PRIOR ART)
FIG. 2 is a perspective view of a typical turbine blade shroud of the prior art.

FIG. 2 depicts a tip portion of a prior art shrouded turbine blade 90, which comprises an airfoil section 91 and a shroud 92. The shroud 92 has a thickness defining opposed bearing or contact faces 93, which are shaped to facilitate interlocking of adjacent shrouds. Shroud 92 includes stiffening rails 94, which help to resist "curling" or centrifugal deflection of the shroud, and may incorporate a gradual change in the thickness 96 across the width of the shroud (i.e. generally along the direction of the airfoil chord), to control bending stresses in the shroud.

Figure 3:
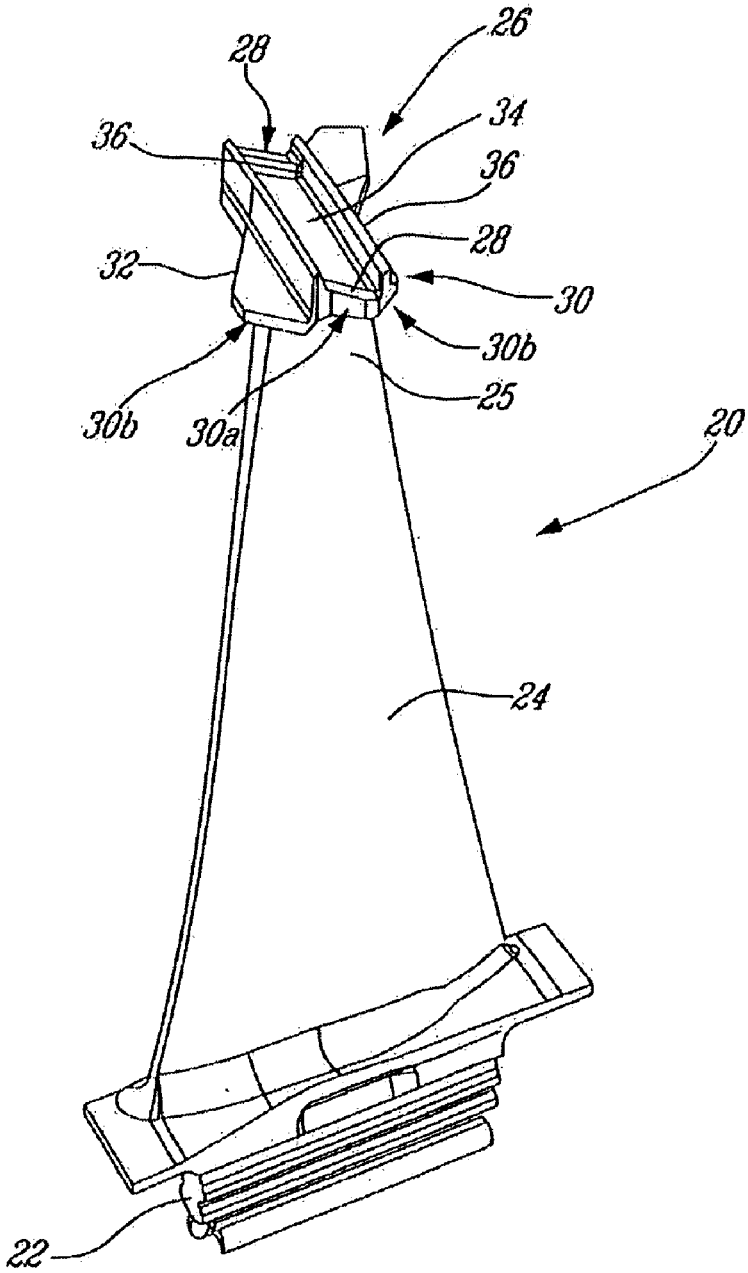
FIG. 3 is a perspective view of a shrouded turbine blade in accordance with the present invention.
Figure 4:
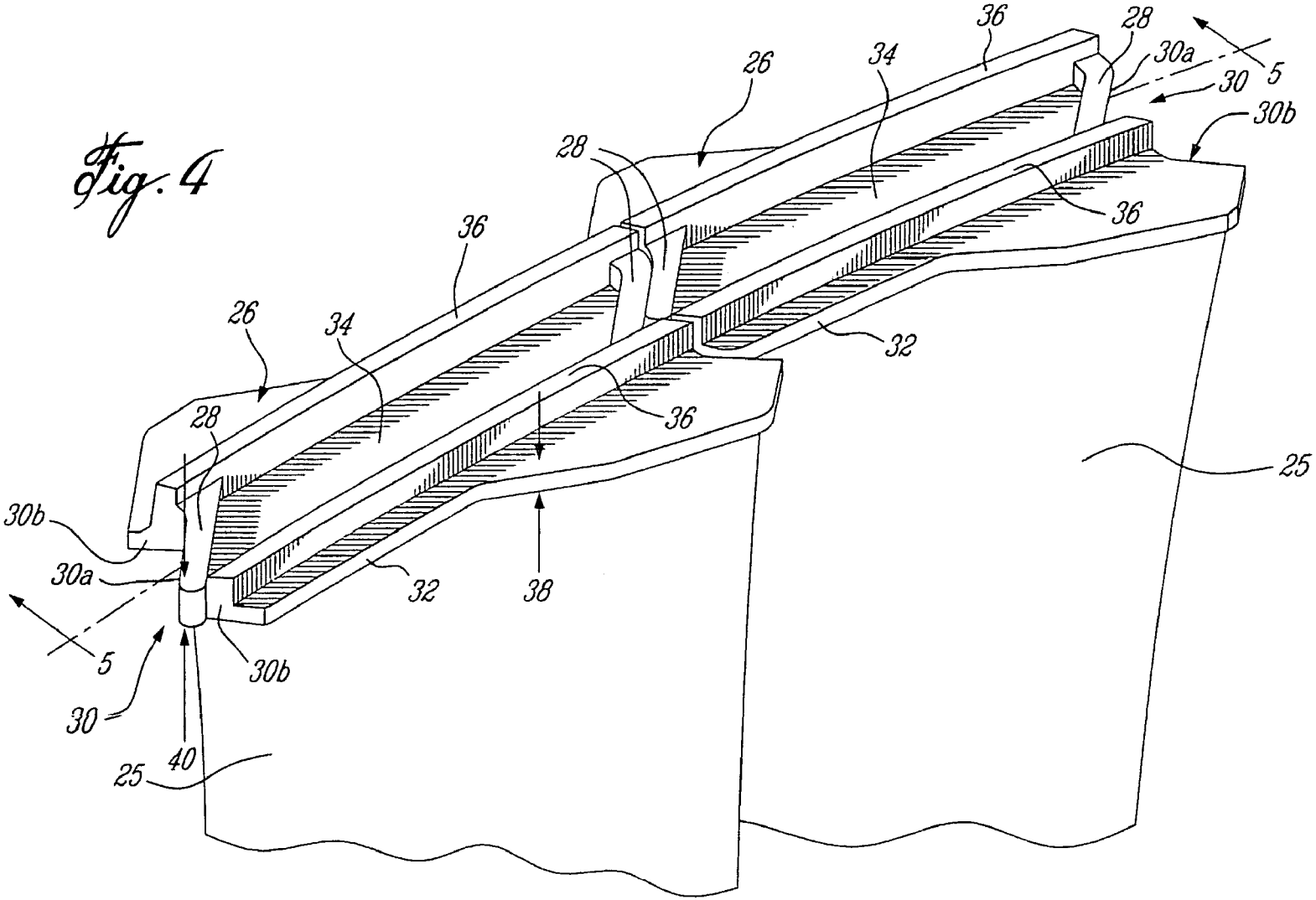
FIG. 4 is a perspective view of two abutted turbine blade shrouds in accordance with the present invention.
Figure 5:
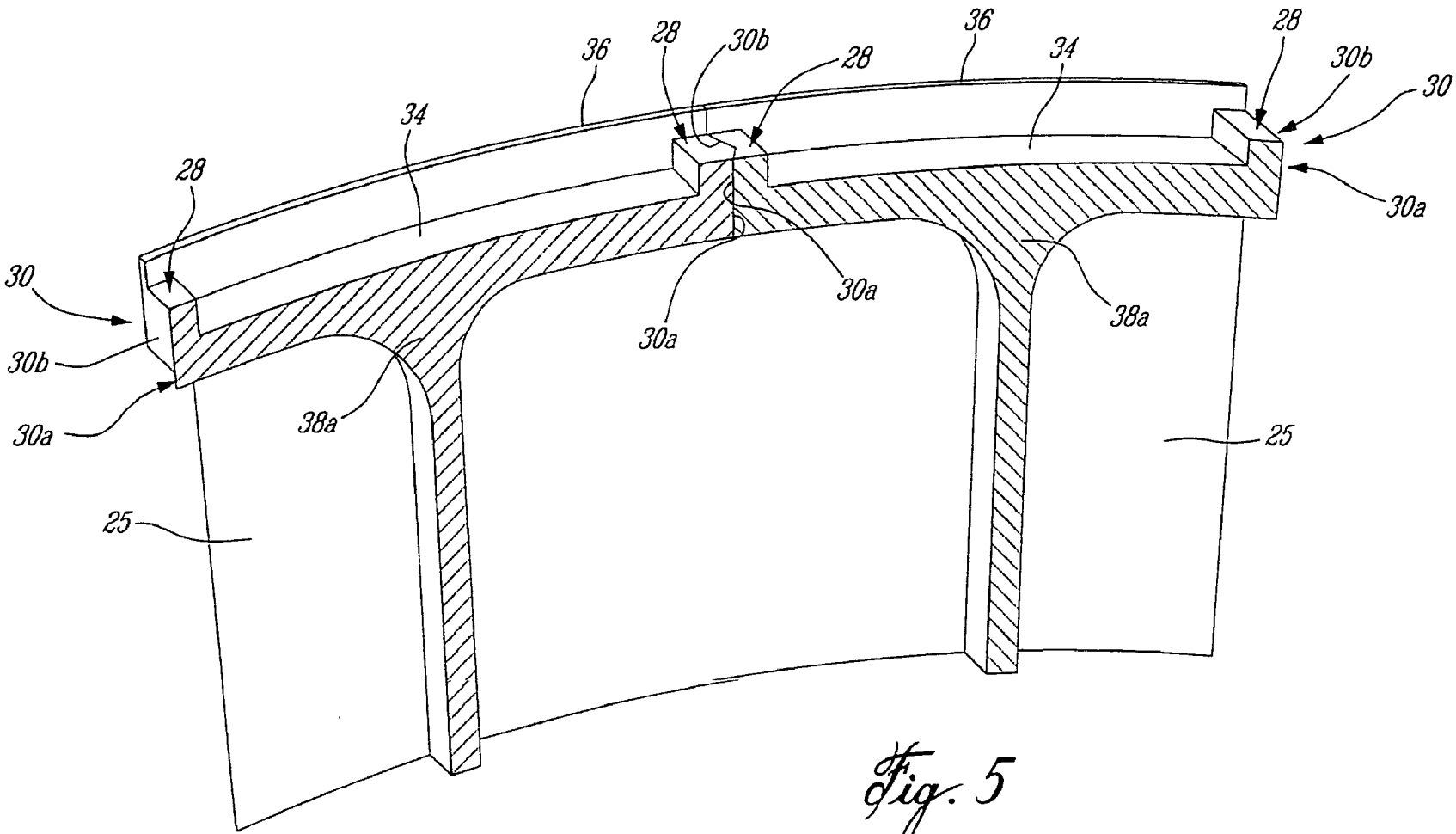
FIG. 5 is a cross-sectional view of two adjacent turbine blade shrouds of FIG. 4, taken along the line 5—5.
Figure 6:
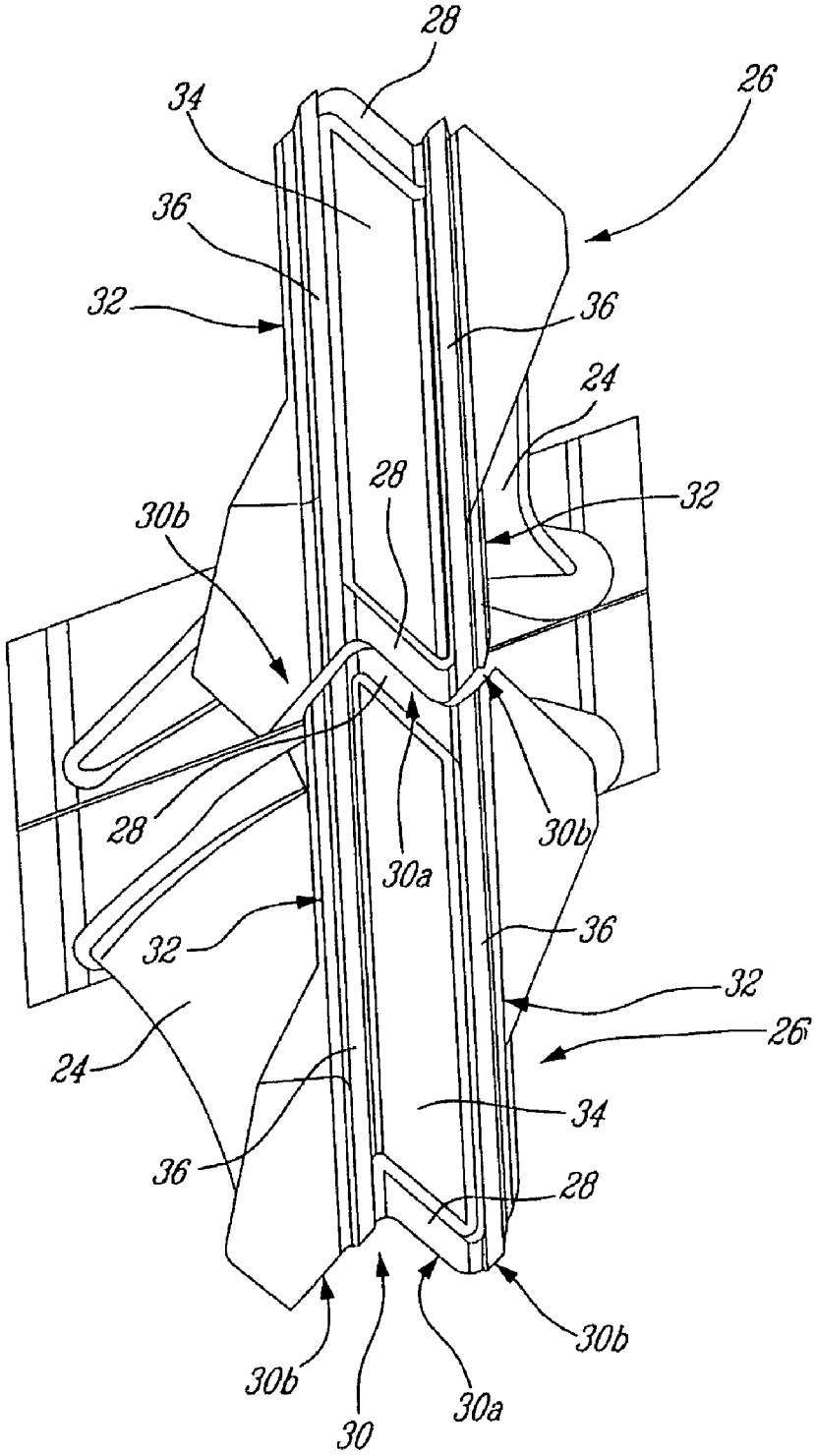
FIG. 6 is a top view of the turbine blades of FIG. 4.

Referring now to FIGS. 3, 4 and 5, the shrouded turbine blade 20 of the present invention comprises generally a root portion 22, an airfoil portion 24 and a shroud portion 26. The shroud 26 is engaged to a tip 25 of the airfoil 24 and rigidly extends at least laterally from the airfoil 24, and more preferably generally perpendicularly therefrom. One skilled in the art will understand that the angle between them is not exactly perpendicular, since the blade extends on a radius from a centre point, while the shroud is a body of revolution which forms an annulus (or portion thereof) about that centre point, however for convenience this angle is described in this application as "generally perpendicular". The shroud 26 comprises a generally planar prismatic body portion 34 having a pair of opposed bearing faces 30, adapted for abutment with similar bearing faces of adjacent shrouded blades 20, and a pair of opposed and generally parallel non-bearing faces 32. One skilled in the art will understand that the shroud is not exactly planar nor prismatic (i.e. flat), since it is a body of revolution which forms an annulus (or portion thereof) about a centre point (e.g. the rotor axis), however for convenience the shroud is described in this application as "generally planar". The two bearing or contact faces 30 have a contacting portion 30*a*, which is preferably planar and generally at an angle from a plane perpendicular to the turbine, and a non-contacting portion 30*b* which is preferably planar and generally at a different angle from a plane perpendicular to the turbine, such that the face 30 has a shape such as a Z-shape (see FIGS. 4–6). Two knife edges 36, which radially outwardly project from the body 34 of the shroud 26 and extend thereacross from one bearing face 30 to the other, help provide a blade tip seal with the surrounding shroud ring providing stiffening rails which help resist "curling" or centrifugal deflection of the turbine blade shroud 26. The body portion 34 has a nominal thickness 38 along most of its length, however typically has a locally increased thickness in a portion 38*a* adjacent the airfoil to address bending stresses induced by bending between the airfoil and the shroud. However, bearing face edge projections 28 extend radially and preferably outwardly from the shroud body portion 34 at both ends thereof. The edge projections 28 preferably have a substantially constant thickness 40, and thickness 40 is greater than nominal thickness 38 of the shroud body portion 34. The transition between the shroud body portion 34 and the edge projections 28 is discontinuous, and therefore the transition between the nominal body thickness 38 and the edge projection thickness 40 is discontinuous. This discontinuous increase in thickness occurs immediately adjacent the bearing faces 30 to minimize unnecessary weight. Projections 28 accordingly provide an increased area to bearing faces 30, which thereby have a greater planar surface area than that of the cross-section of the shroud body 34. This increased surface area of the bearing faces 30 is thus adapted to reduce the contact stresses which arise from contact with mating bearing faces of adjacent turbine blades. The edge projections 28 accordingly reduce contact stress between adjacent blade shrouds 26, thereby minimizing fretting wear on the shroud contact faces 30. As mentioned, the local nature of the increase in shroud material minimizes the overall weight increase. Thus, with the present invention the operational life of the turbine blades can be increased with only a minimal weight trade-off.

The turbine shroud 26 is preferably cast with the rest of the turbine blade 20 as a single element such that the opposed bearing faces are integrally formed with the body portion 34 of the shroud 26. However, the local bearing face edge projections 28 can also be incorporated onto existing shrouded turbine blades, to reduce shroud contact face fretting and increase the contact face life. Existing cast shrouded turbine blades could easily include such edge projections 28, through a relatively minor casting tool change. Further, the edge projections 28 can also be added as a post-production add-on or blade repair process, being added to the turbine shroud using methods which are known to one skilled-in the art, such as braze or weld material build-up or other method. Accordingly the present invention also permits increases to the shroud contact face surface area to reduce contact stress between already-manufactured turbine shrouds.

Figure 7:
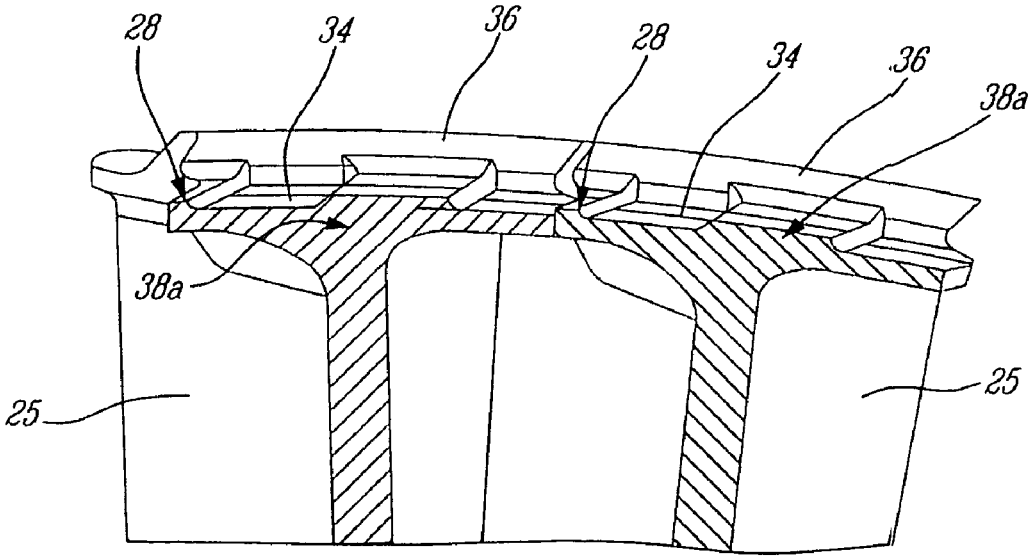
FIG. 7 is a cross-sectional view similar to FIG. 5, depicting an alternate embodiment of the present invention.
Figure 8:
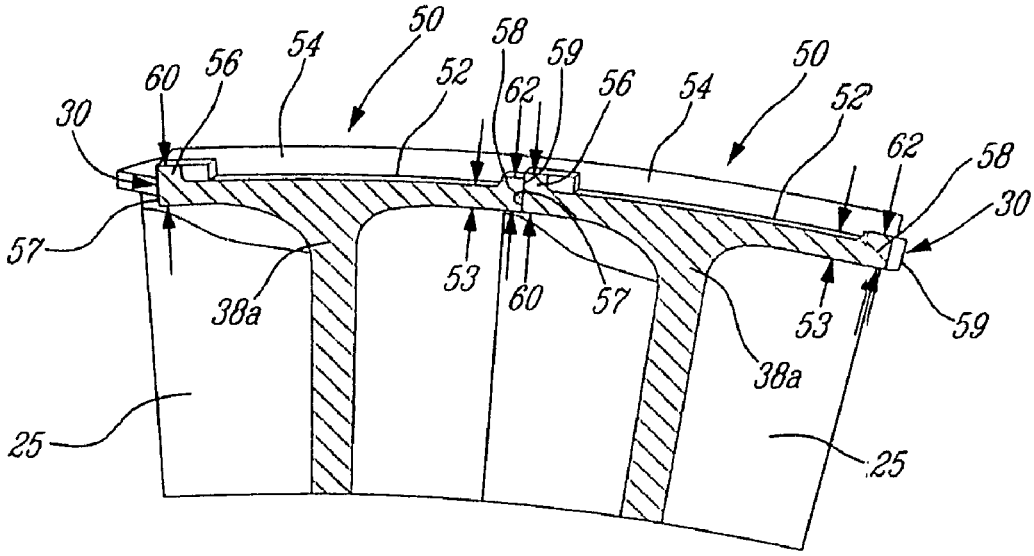
FIG. 8 is a cross-sectional view similar to FIG. 5, depicting another embodiment of the invention.

Further, although the bearing face edge projections 28 are preferably disposed on both ends of the shroud 26 as depicted in FIGS. 3–5, a single edge projection 28 can alternately be provided, being located on one end of the shroud as depicted in FIG. 7. As shown in FIG. 8, and described in more detail below, projections may be provided on both contact faces 30, but provided in different heights. When the edge projections are thus un-symmetrically located only on one of the pressure or suction side of the shroud, contact stress remains generally constant (i.e. does not increase) with the present invention during any shroud curling which occurs. As turbine shroud contact faces wear, shroud deflection can more easily cause a misalignment of the contact faces when the engine is running. If this misalignment is considerable, bearing stress on the contact faces of the shroud can be significantly increased. Higher bearing stresses on the contact faces accelerates wear of these faces. As the contact faces wear within allowable limits, the shroud can deflect in a manner which misaligns the contact faces, which leads to further acceleration of wear. Providing a single contact face edge projection 28 can help ensure that the contact face area is maintained during all engine operating conditions and when shroud curling occurs. This helps to reduce the misalignment of the two abutting contact faces, thereby limiting the bearing stress on the contact faces.

As mentioned, in an alternate embodiment, two abutting contact face edge projections 56/58 of uneven size, as depicted in FIG. 8, can be provided to accommodate misalignment of contact/bearing faces of the shroud in a manner similar to FIG. 7, thereby limiting bearing stress on the contact faces. Such alternate turbine shrouds 50, similarly engaged to the airfoil tips 25 of the turbine blade, generally comprise a main shroud body portion 52 having a nominal thickness 53, a first bearing face edge projection 56 at one end of the shroud and having a first thickness 60, and a second bearing face edge projection 58, at the opposed end of the shroud, having a second smaller thickness 62. Accordingly, abutting shroud edge projections necessarily form uneven local thickness increases, such that the larger area bearing face 57 on the first edge projection 56 mates with a smaller area bearing face 59 on the second smaller edge projection 58. The increase in thickness immediately adjacent the bearing faces defines the increased surface area size of the bearing face thereon. At least one knife edge 54 is also provided on the shroud 50, extending between opposed and differently sized bearing faces 57 and 59.

Accordingly, increasing the bearing face surface area of the turbine shrouds, as per the present invention, is the key to reducing contact stress between abutting shrouds. This invention, however, is counter-intuitive especially in aero-applications since weight increase itself is almost always a taboo topic. Also in the particular instance of shrouded rotating blades, since any weight increase in the shroud increases dynamic deflections due to the extremely high rate of rotation (e.g. above 20,000 rpm), additional weight misaligns the contact faces and will lead to a yet further increase in contact stress. For this reason, previous attempts to reduce contact stress between abutting shrouds have all generally involved using surface coatings or other inserts which do not significantly add weight to the shroud. However, the present invention is surprising in its results, as a relatively minimal weight increase allows a significantly increased bearing face wear life. Accordingly, the weight added is intentionally minimal to achieve considerable reductions in bearing face contact stresses. For example, by extending the bearing face edge projections along the full length of the contacting portion of the bearing face, the contact stresses can be reduced with only a very minimal weight penalty.

Further, the simple geometry of the shrouds of the present invention make them relatively easy to design and produce, which of course can result in significant cost and time savings. Unlike the prior art, the turbine shroud of the present invention does not compromise the shroud stiffness, nor does it significantly increase the shroud to airfoil interface stress concentrations, which are produced in all shrouded turbines by centrifugal force. Unlike the prior art, stress concentrations are minimized in the present invention by the shroud shape. Some known prior art shrouds (see, for example, FR 1,252,763) are designed with inherent shroud flexibility relative to the airfoil, such that the blades can be assembled with a given level of flexion, permitting the shroud to airfoil interface stress to be reduced by centrifugal force. Such prior art is not directed to reducing contact stress, and in fact generally leads to an undesirable increase in shroud face contact stresses. For example, the shroud of one embodiment of FR'763 is acutely angled relative to the blade to permit the shroud to be flexible in response to dynamic forces, in an effort to reduce bending stresses at the blade root. To accommodate such flexion, FR'763 provides long contact faces on the shroud as a means to ensure that contact between adjacent shroud faces is maintained as inevitable non-uniform shroud flexion occurs. The flexing of adjacent shrouds is never identical (and hence the need to the long contact faces) and the rotating nature of the flexion causes point contact (as opposed to face contact) to occur between adjacent shrouds. Thus the FR'763 design inevitably results in serious local stress concentrations on the shroud contact faces, which is of course undesirable and certainly does not minimize contact face stress. The shrouds of the present invention, however, extend generally perpendicularly from the airfoil and are designed to be substantially rigid relative thereto. Accordingly, significant displacement of the shroud contact faces need not be accommodated.

The embodiments of the invention described above are intended to be exemplary. For example, the invention may be applied to mid-span shrouds, and may incorporate a projection 28 that projects radially inwardly from the shroud, or inwardly and outwardly, as desired. Still other modifications are available, and those skilled in the art will therefore appreciate that the forgoing description is illustrative only, and that various alternatives and modifications can be devised without departing from the spirit of the present invention. Accordingly, the present invention is intended to embrace all such alternatives, modifications and variances which fall within the scope of the appended claims.

What is claimed is:

1. A one-piece blade for a turbine section of a gas turbine engine, the blade comprising a root, an airfoil and a shroud, wherein the shroud extends generally perpendicularly from a tip of the airfoil and is defined by a pair of opposed bearing faces integrally formed with said shroud and a pair of opposed non-bearing fares, the bearing faces each having a contact portion adapted to contact a shroud of an adjacent blade, the shroud having a portion extending between the contact portion of the bearing faces and having a substantially constant nominal thickness, the bearing faces having a substantially constant face thickness across the contact portion greater than the nominal thickness, the transition between the face thickness of the bearing faces and the nominal thickness of said portion being substantially discontinuous.

2. A one-piece blade according to claim 1 wherein the shroud is generally planar.

3. A one-piece blade according to claim 1 wherein the bearing faces are generally planar.

4. A one-piece blade according to claim 1 wherein the contact portions are generally at an angle from a plane perpendicular to the airfoil.

5. A one-piece blade according to claim 1 further comprising a pair of knife edges extending from the shroud, each of the knife edges extending across an outer surface of the shroud from one bearing face to the other.

6. A one-piece blade according to claim 5, wherein the shroud is generally prismatic but for discontinuities at the opposed bearing faces and but for the knife edges.

7. A blade for a turbine section of a gas turbine engine, the blade comprising:

an airfoil portion extending from a root portion to a tip portion; and a shroud pardon extending laterally from the airfoil portion, the shroud portion having a body having a substantially constant thickness and a pair of opposed bearing faces integrally formed with said body each having contact portions adapted to matingly contact a bearing face contact portion of a shroud portion of an adjacent turbine blade, wherein the body has a generally planar portion extending between the opposed bearing faces and having the constant thickness, at least one of the opposed bearing faces having a discontinuous increase in thickness relative to the constant thickness immediately adjacent the contact portion of the at least one of the opposed bearing faces to thereby provide substantially all of the contact portion with an increased surface area associated with said increased thickness, and wherein said increased surface area is adapted to lower contact stresses arising from contact with at least one mating bearing face of said adjacent turbine blades.

8. A blade according to claim 7 wherein the shroud portion extends generally perpendicularly to the airfoil.

9. A blade according to claim 7 wherein the shroud portion extends from a tip portion of the airfoil.

10. A blade according to claim 7 wherein the increase in thickness of the shroud portion is discontinuous.

11. A blade according to claim 7 wherein the shroud portion is generally planar.

12. A blade according to claim 7 wherein the at least one bearing face is generally planar.

13. A blade according to claim 7 wherein the at least one bearing face is generally at an angle to a plane perpendicular to the airfoil portion.

14. A blade according to claim 7 wherein the at least one opposed bearing face comprises both opposed bearing faces.

15. A blade according to claim 7 further comprising at least one knife edge portion which extends from the shroud portion, the knife edge portion extending across the shroud portion from one of the opposed bearing faces to the other.

16. A blade according to claim 7 wherein the shroud portion extends substantially rigidly from the airfoil portion.

17. A method of reducing face contact stress in a shroud contact face of a shrouded turbine blade, the method comprising the steps of:

determining a desired shroud design for a given turbine blade design, the shroud design including a nominal thickness;

determining a desired face contact stress for at least one shroud contact face of the shroud, the at least one shroud contact face having a contact portion length; and providing a local increase in the shroud nominal thickness to thereby increase the area of the at least one shroud contact face along said contact portion length, wherein the increase in area corresponds to the desired face contract stress, and wherein the local increase is limited to a region immediately adjacent the at least one shroud contact face.

* * * * *

UNITED STATES PATENT AND TRADEMARK OFFICE

CERTIFICATE OF CORRECTION

PATENT NO. : 7,001,152 B2
APPLICATION NO. : 10/681341
DATED : February 21, 2006
INVENTOR(S) : René Paquet, Nicolas Grivas and Richard Brandt It is certified that error appears in the above-identified patent and that said Letters Patent is hereby corrected as shown below:

In the Assignee:

delete "Wiley" and insert --Whitney--

Signed and Sealed this

Eighth Day of August, 2006

JON W. DUDAS
*Director of the United States Patent and Trademark Office*